US006053547A

United States Patent [19]

Lemieux

[11] Patent Number: 6,053,547

[45] Date of Patent: Apr. 25, 2000

[54] SLIDING DOOR LOCKING DEVICE

[75] Inventor: Armand Lemieux, Gorham, N.H.

[73] Assignee: Robert Lemieux, Hampstead, N.H.

[21] Appl. No.: 09/251,684

[22] Filed: Feb. 17, 1999

[51] Int. Cl.[7] ..... E05C 19/08

[52] U.S. Cl. ..... 292/281; 292/283; 292/285; 292/288; 70/2

[58] Field of Search ..... 70/2–13, 53–56, 70/14; 292/281, 288, 289, 285, 286, 297, DIG. 46, 292, 295, 258

[56] References Cited

U.S. PATENT DOCUMENTS

| | | | |
|---|---|---|---|
| 51,787 | 1/1866 | Avery | 292/281 |
| 58,091 | 9/1866 | Fox | 292/281 |
| 463,361 | 11/1991 | Frazier | 70/14 |
| 511,840 | 1/1894 | Frazier et al. | 70/14 |
| 543,232 | 7/1895 | Firfield | 292/281 |
| 648,051 | 4/1900 | Payne | 292/241 |
| 688,747 | 12/1901 | McMillen | 292/281 |
| 878,047 | 2/1908 | Darracott | 292/205 |
| 986,465 | 3/1911 | Keppele | 292/282 |
| 1,497,117 | 1/1924 | Trimmer | 118/712 |
| 1,623,050 | 4/1927 | Frantz | 292/281 |
| 1,883,165 | 10/1932 | Vegren | 292/283 |
| 2,183,834 | 12/1939 | Ferris | 292/283 |
| 2,198,079 | 4/1940 | Ferris et al. | 292/143 |
| 2,228,361 | 1/1941 | O'Neil | 70/101 |
| 3,279,829 | 10/1966 | Kurtenacker et al. | 292/281 |
| 3,317,230 | 5/1967 | Demrick et al. | 292/281 |
| 3,734,552 | 5/1973 | Haxton | 292/67 |
| 3,834,746 | 9/1974 | Hinden | 292/290 |
| 3,843,178 | 10/1974 | Eskoff | 292/262 |
| 4,405,165 | 9/1983 | Johns | 292/258 |
| 4,653,785 | 3/1987 | Tobey | 292/258 |
| 4,668,899 | 5/1987 | Ide et al. | 318/280 |
| 4,793,163 | 12/1988 | MacFarlane et al. | 70/281 |
| 5,154,459 | 10/1992 | Cochran | 292/258 |
| 5,291,760 | 3/1994 | Schrader | 70/14 |
| 5,324,897 | 6/1994 | Melgoza et al. | 200/43.11 |
| 5,456,506 | 10/1995 | Bartlett | 292/281 |
| 5,489,130 | 2/1996 | Clark | 292/66 |

*Primary Examiner*—B. Dayoan
*Assistant Examiner*—John B. Walsh
*Attorney, Agent, or Firm*—Bourque & Associates, P.A.

[57] ABSTRACT

A sliding door locking device is used to lock a sliding door, such as an overhead sliding door used in garages, storage trailers and the like. The sliding door locking device includes a door mounting member that is positioned over an edge or top portion of the sliding door and a movement restricting member that locks to the door mounting member and abuts a structural support to restrict movement of the sliding door. One example of the door mounting member includes a locking pin and a locking ring. The movement restricting member includes a locking slot for receiving and locking with the locking pin and a hasp having an aperture for receiving the locking ring. A padlock or other locking mechanism is inserted through the locking ring to lock the movement restricting member to the door mounting member. The sliding door locking device thus provides a secondary lock that locks the sliding door from the outside without having to be permanently mounted to the door or other structure.

13 Claims, 5 Drawing Sheets

SLIDING DOOR LOCKING DEVICE

FIELD OF THE INVENTION

The present invention relates to door locking devices and in particular, to a sliding overhead door locking device that slidably mounts to a top portion of an overhead door and prevents the overhead door from being opened.

BACKGROUND OF THE INVENTION

Sliding doors, such as sliding overhead doors, are commonly used in various types of structures. In a garage, for example, automatic sliding overhead doors are commonly used. The automatic doors are typically activated by a remote control or by a switch within the garage or house. One common problem with automatic overhead doors occurs when there is a power failure. Although overhead garage doors typically have a release mechanism that allows the door to be manually operated during a power failure, these doors often cannot be locked once the door has been released. Thus, a secondary lock is needed to prevent theft, vandalism and other types of unauthorized entry when the door has been released.

Another situation in which a secondary lock is needed on a sliding door occurs when a garage is being rented. The door may have a manual locking mechanism that locks the door, but a secondary lock is needed so that the individual renting the space can separately lock the door and prevent unauthorized access. Storage trailers with sliding doors (e.g., at construction sites) also have a need for secondary locking.

Existing manual locks have a number of drawbacks. In particular, existing locking devices typically involve complex locking mechanisms with multiple moving parts that are difficult to install and use with the sliding door. Many existing locking devices also must be permanently mounted to the door or other supporting surface and cannot easily be removed without damaging the surface. Other existing door locking devices can only be locked from within the garage.

Accordingly, a need exists for a sliding door locking device that provides secondary locking for a sliding door to prevent unauthorized opening of the door. A need also exists for a sliding door locking device that can be removably mounted to the sliding door without damaging the door and that allows the door to be locked from the outside.

SUMMARY OF THE INVENTION

The present invention features a sliding door locking device comprising a door mounting member for removably mounting to a portion of a sliding door and a movement restricting member for locking to the door mounting member and for abutting a structural support proximate the sliding door to restrict movement of the sliding door.

According to the preferred embodiment, the door mounting member includes a door receiving region for slidably receiving an edge of the door. In one embodiment, the door mounting member includes a first or front mounting member portion or plate for positioning against a front portion of the sliding door, a second or top mounting member portion or plate extending from the first mounting member plate for positioning over an edge portion of the sliding door, and a third or back mounting member portion or plate extending from the second mounting member plate for positioning against a back portion of the sliding door. The first, second and third mounting member portions or plates form the door receiving portion.

The movement restricting member preferably includes a first movement restricting member portion or plate for locking to the door mounting member and a second movement restricting member portion or plate, extending from the first movement restricting member plate, for abutting the structural support.

The door mounting member preferably includes at least one locking element extending therefrom for engaging the movement restricting member. One example of the locking element includes a locking ring extending from the door mounting portion. In one embodiment, the movement restricting member includes a pivotable hasp having an aperture for receiving the locking ring. According to this embodiment, the door mounting member further includes at least one locking pin having an enlarged head portion. The movement restricting member includes at least one locking slot having an enlarged opening for receiving the enlarged head portion of the locking pin. The locking pin is received in the enlarged opening and slides in the locking slot to a locking position where the enlarged head is locked in the locking slot.

According to an alternative embodiment, the front movement restricting member portion includes one or more apertures for receiving the locking ring(s) extending from the first or front mounting member portion or plate. Each locking ring is adapted to receive a locking mechanism to lock the movement restricting member to the door mounting member.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
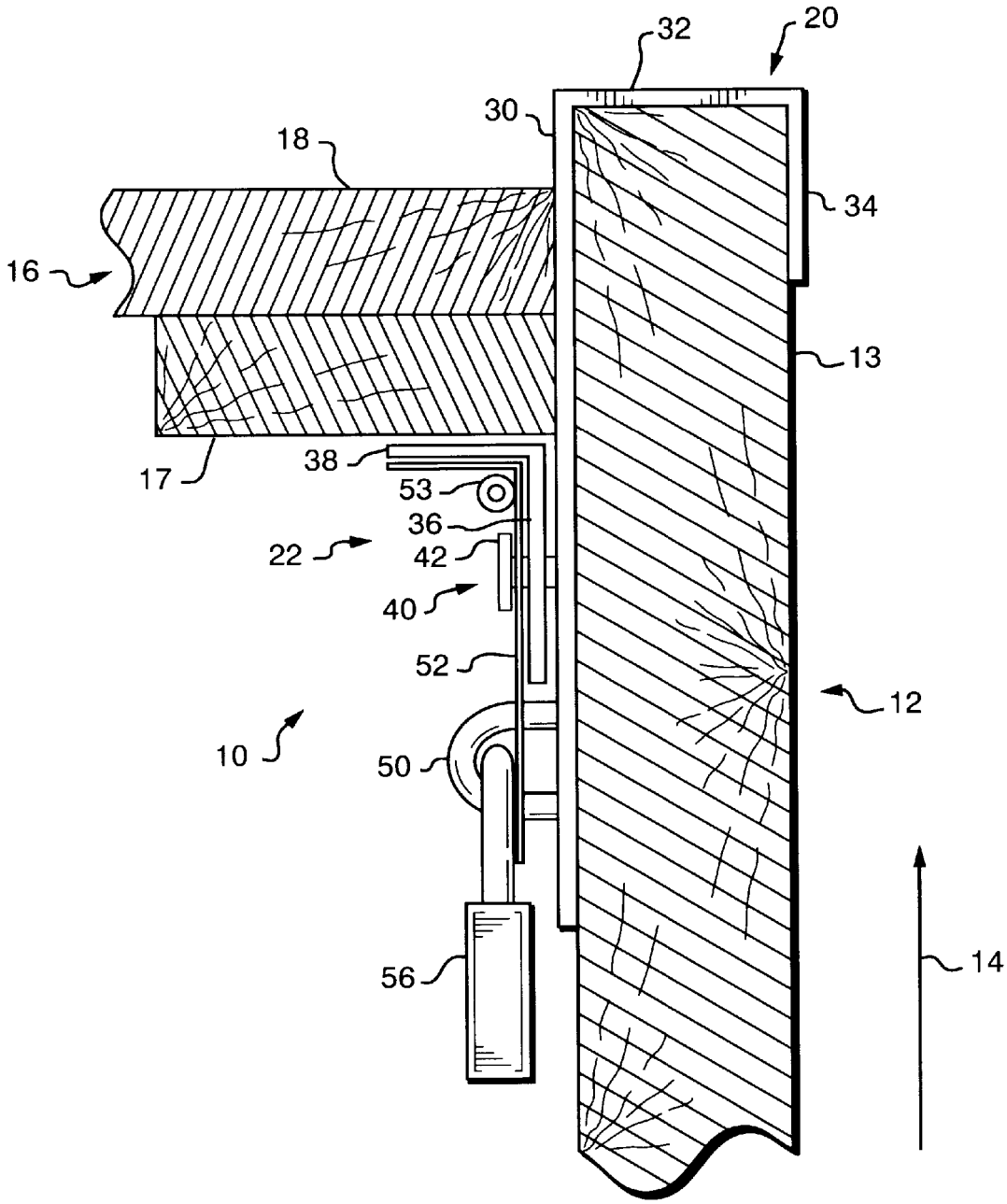
FIG. 1 is a side view of the sliding door locking device mounted on a sliding door, according to the present invention.
Figure 2:
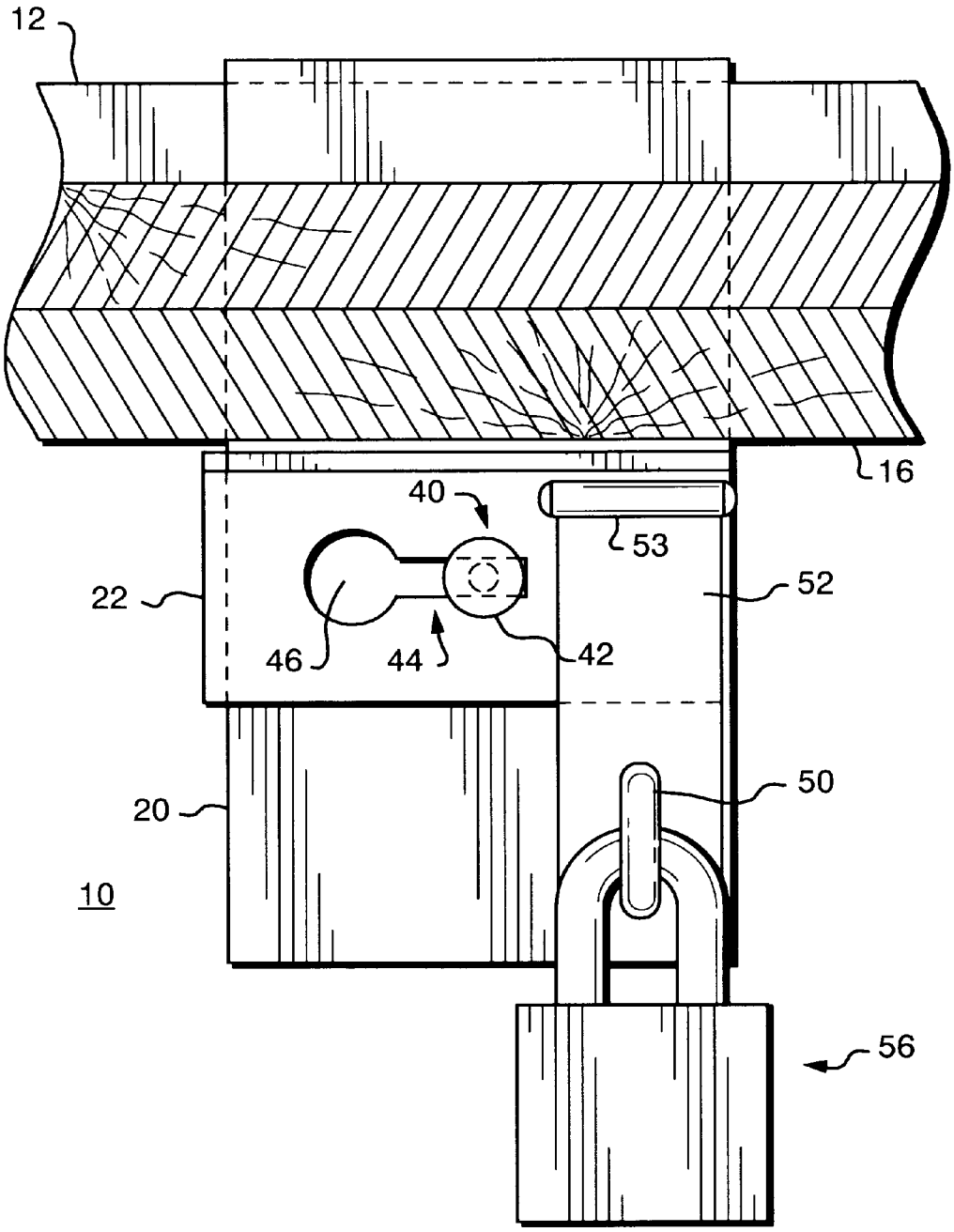
FIG. 2 is a front view of the sliding door locking device, according to the present invention.

A sliding door locking device 10, FIGS. 1 and 2, according to the present invention is used to lock a sliding door 12, such as a garage door or other type of overhead sliding door that moves generally in the direction of arrow 14. In the exemplary embodiment, the top portion 13 of the sliding door 12 is positioned proximate a support structure 16 including, for example, a ferring 17 secured to a casing 18 around a garage door. Although the exemplary embodiment is described with respect to an overhead sliding door, such as a garage door or storage trailer door, the present invention contemplates using the sliding door locking device 10 on any type of sliding door.

The sliding door locking device 10 includes a door mounting member 20 that is removably mounted to the sliding door 12 and a movement restricting member 22 that engages and locks to the door mounting member 20, as will be described in greater detail below. If an attempt is made to open the sliding door 12 when the movement restricting member 22 is engaged with the door mounting member 20, the movement restricting member 22 will abut the support structure 16 and restrict movement of the sliding door 12.

According to the exemplary embodiment, the door mounting member 20 includes a first or front mounting member portion 30, a second or top mounting member portion 32, and a third or back mounting member portion 34. The mounting member portions 30, 32, 34 together form a door receiving region that slidably receives the top portion 13 of the door 12. The door mounting member 20 is preferably positioned over the top portion 13 of the overhead sliding door 12 such that the first or front mounting member portion 30 is positioned on the front side of the door 12 proximate the support structure 16. In the exemplary embodiment, the door mounting member is made from ⅛" thick strap iron, which is stamped to shape such that the mounting member portions 30, 32, 34 are generally flat plates. In one example, the door mounting member 20 is about 3 in. wide and 5⅜ in. long and is dimensioned to slide over an overhead garage door 12 having a thickness of about 1⅜ in. The thickness and dimensions of the mounting member portions or plates 30, 32, 34 vary depending upon the type and size of the door 12 on which the locking device 10 is used. When used on a trailer door, for example, the space between the plates 30, 34 is about 1 inch.

The exemplary embodiment of the movement restricting member 22 includes a first or front movement restricting member portion 36 and a second or top movement restricting member portion 38. In one example, the movement restricting member 22 is made from a 1 in. by 1½ in. angle iron and the movement restricting member portions 36, 38 are generally flat plates. The first or front movement restricting member portion 36 engages the door mounting member 20, as will be described below, and the second movement restricting member portion 38 abuts the structural support 16 when an attempt is made to move the door 12 in the direction of arrow 14. The present invention contemplates other shapes and dimensions for the movement restricting member 22.

Figure 3:
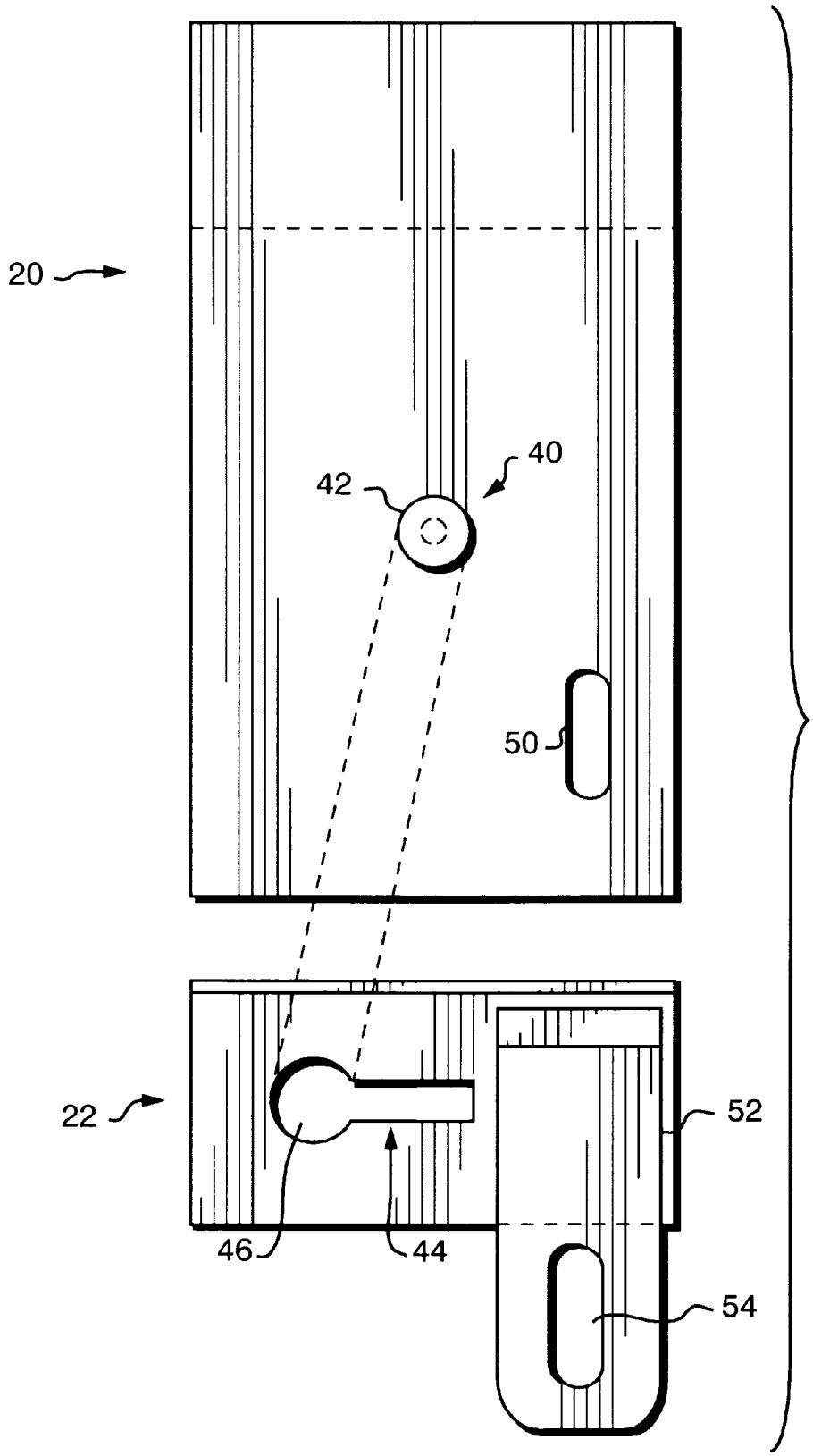
FIG. 3 is an exploded front view of the sliding door locking device, according to the present invention.

According to one embodiment, the door mounting member 20, FIG. 3, includes a locking pin 40 having an enlarged head portion 42 and the movement restricting member 22 includes a locking slot 44 having an enlarged opening 46 for receiving the enlarged head portion 42 of the locking pin 40. In this embodiment, the door mounting member 20 includes at least one locking element 50, such as a locking ring, and the movement restricting member 22 includes a pivotable hasp 52 having an aperture 54 that receives the locking element 50. The locking element 50 receives a locking mechanism 56, such as a conventional padlock or other similar locking mechanism (see FIGS. 1 and 2).

In one example, a hole is drilled generally at the center of the first mounting member plate 30 and the locking pin 40 is inserted in the hole and spot welded to the door mounting member 20. One example of the locking pin 40 includes a rivet having a stem of about 3/16 inches and an enlarged head portion of about 7/16 inches. The locking slot 44 is formed in the first movement restricting member portion 36, for example, by drilling a hole (e.g., about ½ in. in diameter) and slotting. The hasp 52 can be attached to the movement restricting member 22 by spot welding a pivot element 53 of the hasp 52, for example, to the top plate 38.

In use, the door mounting member 20 is first placed over the edge portion of the sliding door 12. When used on an overhead sliding door, for example, the overhead sliding door 12 must be partially opened such that the door mounting member 20 can be positioned over the top portion 13 of the door 12. The door 12 is then closed with the door mounting portion 20 secured over the top portion of the overhead sliding door 12. The enlarged opening of the locking slot 44 on the movement restricting member 22 is then aligned with the locking pin 40. The enlarged head portion 42 is inserted into the enlarged opening 46 and the locking pin 40 is slid along the locking slot 44 until the aperture 54 in the hasp 52 is aligned with the locking element or ring 50. The locking element or ring 50 is inserted through the aperture 54 in the hasp 52, and the padlock 56 or other similar locking mechanism is inserted through the locking element or ring 50 and the door mounting member 20 and movement restricting member 22 are locked together.

Figure 4:
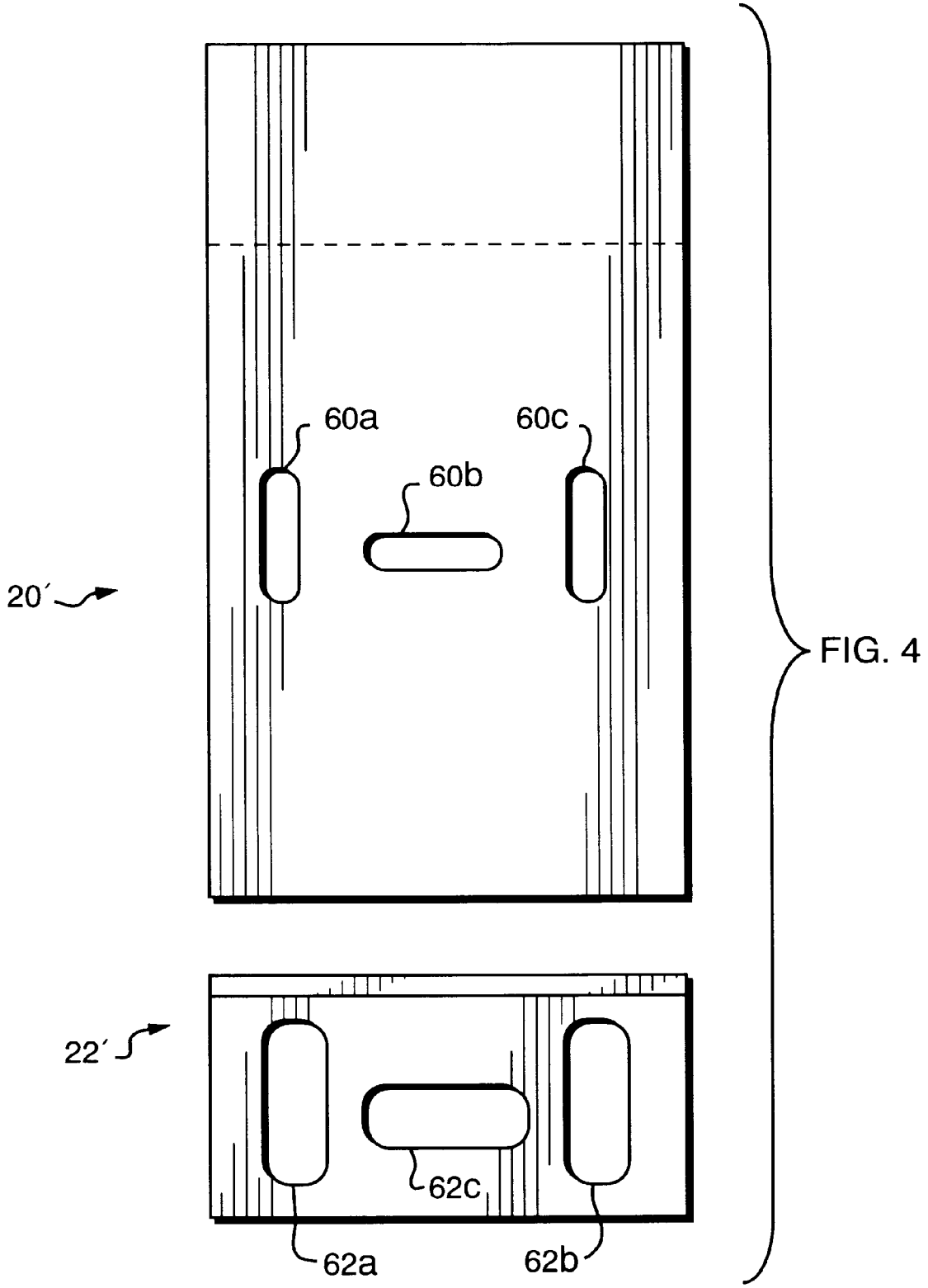
FIG. 4 is an exploded view of a sliding door locking device, according to an alternative embodiment of the present invention.

According to an alternative embodiment, the door mounting member 20', FIG. 4, includes one or more locking elements or rings 60*a*, 60*b*, 60*c* and the movement restricting member 22' includes one or more apertures 62*a*, 62*b*, 62*c* for receiving the locking element(s) 60*a*, 60*b*, 60*c*. One or more padlocks 56 or other locking mechanisms are then inserted through the locking element(s) 60*a*, 60*b*, 60*c* to lock the movement restricting member 22' to the door mounting member 20'. The locking elements or rings 60*a–c* can have any orientation, such as vertically oriented locking elements or rings 60*a*, 60*b*, or horizontally oriented locking elements or rings 60*c*. The present invention further contemplates other types of locking elements and other ways of engaging and locking the movement restricting member 22, 22' to the door mounting member 20, 20'. The locking element(s) 60*a*, 60*b*, 60*c* are positioned on the door mounting member 20' such that the movement restricting member 22' engaged with the door mounting member 20' will abut the support structure 16 when the door is moved. If the locking device is used on a trailer door, for example, the locking element(s) 60*a*, 60*b*, 60*c* should be closer to the top of the door mounting member 20' since the trailer casing typically does not have a ferring.

Figure 5:
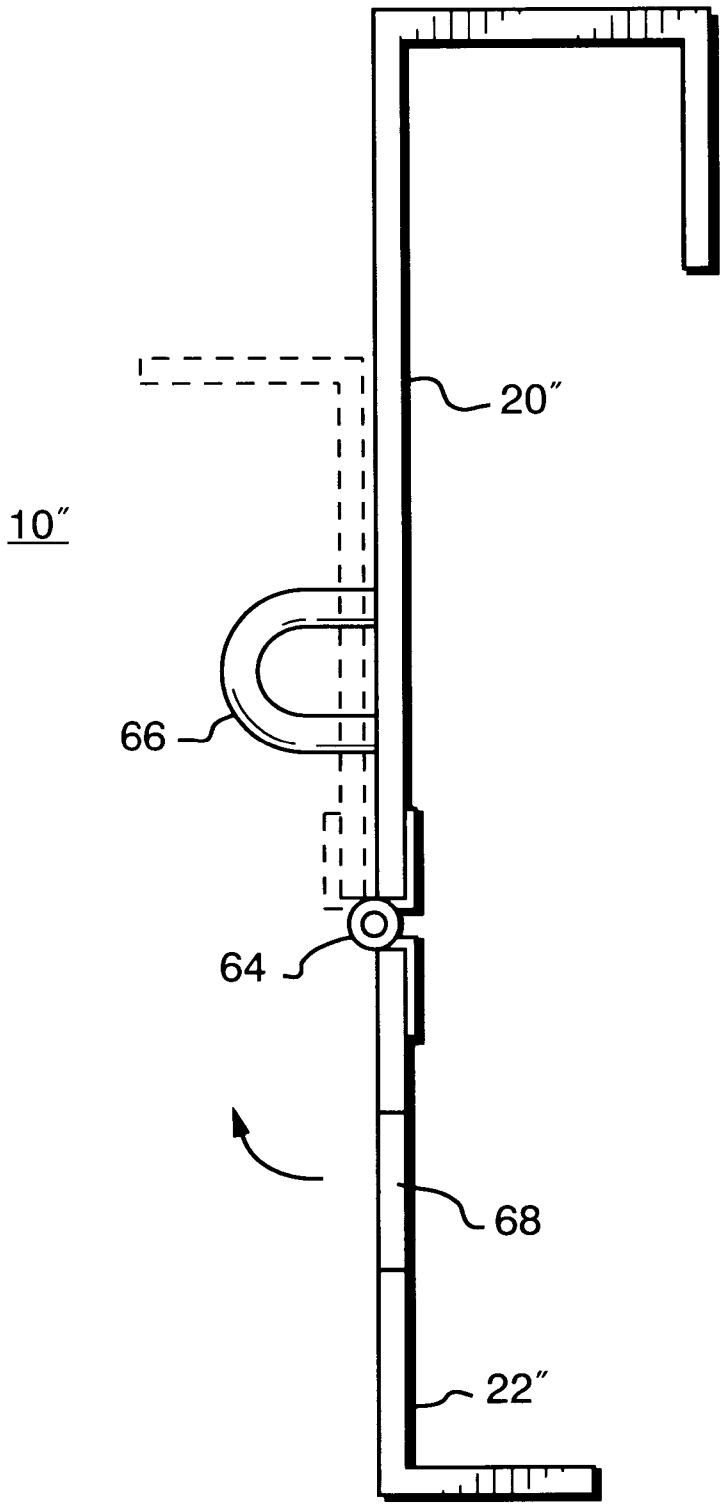
FIG. 5 is a side view of a sliding door locking device, according to another embodiment of the present invention.

According to a further alternative, the door locking device 10", FIG. 5, includes a door mounting member 20" and a movement restricting member 22" that are pivotably coupled, for example, using a piano hinge 64. The movement restricting member 22" pivots into position against the door mounting member 20" and a locking element 66, such as a locking ring, extends through a locking slot 68 on the movement restricting member 22". A padlock or other locking mechanism (not shown) holds the movement 17 restricting member 22" in the locking position.

Accordingly, the sliding door locking device of the present invention is easily installed on a sliding door, such as an overhead sliding door, by positioning the door mounting member over an edge or top portion of the sliding door without having to permanently mount the locking device. The locking device can thus be easily removed from the door to be used on other sliding doors. The sliding door locking device of the present invention can also be locked from the outside of the door.

Modifications and substitutions by one of ordinary skill in the art are considered to be within the scope of the present invention which is not to be limited except by the claims which follow.

It is claimed:

1. A sliding door locking device comprising:

a door mounting member for removably mounting to a portion of a sliding door, said door mounting member including at least one locking element extending therefrom; and a movement restricting member pivotably coupled to said door mounting member for pivoting into engagement with said locking element and locking to said door mounting member and for abutting a structural support proximate said portion of said sliding door to restrict movement of said sliding door.

2. The sliding door locking device of claim 1, wherein said door mounting member includes a door receiving portion for slidably receiving an edge of said door.

3. The sliding door locking device of claim 2, wherein said door mounting member includes a first mounting member portion for positioning against a front portion of said sliding door, a second mounting member portion extending from said first mounting member portion for positioning over an edge portion of said sliding door, and a third mounting member portion extending from said second mounting member portion for positioning against a back portion of said sliding door, wherein said first, second and third mounting member portions form said door receiving portion.

4. The sliding door locking device of claim 1, wherein said movement restricting member includes a first movement restricting member portion for locking to said door mounting member and a second movement restricting member portion, extending from said first movement restricting member portion, for abutting said structural support.

5. The sliding door locking device of claim 1, wherein said at least one locking element includes a locking ring extending from said door mounting member, wherein said movement restricting member includes an aperture for receiving said locking ring, and wherein said locking ring is adapted to receive a locking mechanism to lock said movement restricting member to said door mounting member.

6. A sliding door locking device comprising:

a door mounting member including a front mounting member portion, a top mounting member portion, and a back mounting member portion, wherein said front mounting member portion, said top mounting member portion, and said back mounting member portion form a door receiving region for slideably receiving a top portion of a sliding door, said door mounting member including a locking pin extending from said front mounting member portion; and a movement restricting member including a front movement restricting member portion for engaging said door mounting member and a top movement restricting member portion extending from said front movement restricting member portion for abutting a structural support proximate said top portion of said door, said movement restricting member including a locking slot in said front movement restricting member portion for receiving said locking pin, wherein said movement restricting member and said door mounting member are adapted to be locked together.

7. The sliding door locking device of claim 6 wherein said door mounting member includes at least one locking element extending from said front mounting member portion, and wherein said front movement restricting portion includes at least one aperture for receiving said locking element.

8. The sliding door locking device of claim 7, wherein said at least one locking element includes at least one locking ring extending from said front mounting member portion and adapted to be received in said aperture, and wherein said locking ring is adapted to receive a locking mechanism to lock said movement restricting member to said door mounting member.

9. The sliding door locking device of claim 6 wherein said door mounting member includes at least one locking element extending from said front mounting member portion, and wherein said movement restricting member includes at least one pivotable hasp having an aperture for receiving said at least one locking element.

10. The sliding door locking device of claim 6, wherein said locking pin includes an enlarged head portion, and wherein said locking slot includes an enlarged opening adapted to receive said enlarged head portion, whereby said enlarged head portion enters said enlarged opening and slides along said slot to a locking position where said enlarged head portion is locked against said front movement restricting member portion.

11. A sliding door locking device comprising:

a door mounting member including a front mounting member plate, a top mounting member plate, and a back mounting member plate, wherein said front mounting member plate, said top mounting member plate, and said back mounting member form a door receiving region for slideably receiving a top portion of a sliding door, said door mounting member including a locking pin extending from said front mounting member plate and a locking ring extending from said front mounting member plate; and a movement restricting member including a front movement restricting member plate for locking to said door mounting member and a top movement restricting member plate extending from said front abutting member plate for abutting a structural support proximate said top portion of said door, said side movement restricting member including a locking slot for receiving and locking with said locking pin, and said movement restricting member including a pivotable hasp having an aperture for receiving said locking ring such that said locking ring is adapted to receive a locking mechanism to lock said movement restricting member to said door mounting member.

12. The sliding door locking device of claim 11, wherein said locking pin includes an enlarged head portion, and wherein said slot includes an enlarged opening adapted to receive said enlarged head portion, whereby said enlarged head portion enters said enlarged opening and slides along said slot to a locking position where said enlarged head portion is locked against said front movement restricting member plate.

13. The sliding door locking device of claim 12, wherein said aperture in said hasp is aligned with said locking ring in said locking position.

* * * * *